US008349152B2

(12) United States Patent
Peragine

(10) Patent No.: US 8,349,152 B2
(45) Date of Patent: Jan. 8, 2013

(54) CATHODIC FINGER FOR DIAPHRAGM CELL

(75) Inventor: Salvatore Peragine, Sesto San Giovanni (IT)

(73) Assignee: Industrie de Nora S.p.A., Milan (IT)

( * ) Notice: Subject to any disclaimer, the term of this patent is extended or adjusted under 35 U.S.C. 154(b) by 1453 days.

(21) Appl. No.: 11/937,864

(22) Filed: Nov. 9, 2007

(65) Prior Publication Data

US 2008/0128290 A1 Jun. 5, 2008

Related U.S. Application Data

(63) Continuation of application No. PCT/EP2006/004460, filed on May 11, 2006.

(30) Foreign Application Priority Data

May 11, 2005 (IT) ..... MI05A0839

(51) Int. Cl.
*C25B 1/46* (2006.01)

(52) U.S. Cl. ..... 204/282; 204/284; 204/252; 205/531

(58) Field of Classification Search ..... 204/282, 204/284

See application file for complete search history.

(56) References Cited

U.S. PATENT DOCUMENTS

| | | | | |
|---|---|---|---|---|
| 3,871,988 | A | 3/1975 | Harke et al. | |
| 3,910,827 | A | 10/1975 | Raetzsch et al. | |
| 3,988,220 | A | 10/1976 | Gunby | |
| 4,138,295 | A | 2/1979 | DeNora et al. | |
| 5,066,378 | A | 11/1991 | Meneghini | |
| 5,534,122 | A | 7/1996 | Traini | |
| 5,993,620 | A | 11/1999 | Meneghini et al. | |
| 6,214,181 | B1 * | 4/2001 | Iacopetti et al. | 204/256 |
| 6,328,860 | B1 * | 12/2001 | Romine et al. | 204/242 |
| 2005/0236269 | A1 * | 10/2005 | Peragine et al. | 204/283 |

FOREIGN PATENT DOCUMENTS

| | | | |
|---|---|---|---|
| GB | 1 454 215 | A | 11/1976 |
| WO | WO 00/06798 | A1 | 2/2000 |
| WO | WO 01/34878 | A1 | 5/2001 |
| WO | WO 2004/007803 | A1 | 1/2004 |

* cited by examiner

*Primary Examiner* — Arun S Phasge
(74) *Attorney, Agent, or Firm* — Eschweiler & Associates, LLC

(57) ABSTRACT

The invention relates to a structure of a cathodic finger for diaphragm electrolysis cells consisting of an external mesh and an internal reinforcing and current-distributing structure provided with protrusions suitable for maximizing the contact points with the external mesh.

9 Claims, 3 Drawing Sheets

CATHODIC FINGER FOR DIAPHRAGM CELL

REFERENCE TO RELATED APPLICATION

This application is a continuation of PCT/EP2006/004460, filed May 11, 2006, that claims the benefit of the priority date of Italian Patent Application No. MI2005A000839, filed on May 11, 2005, the contents of which are herein incorporated by reference in their entirety.

BACKGROUND

The production of chlorine by electrolysis of alkali halide solutions, in particular of sodium chloride solutions, is still largely the electrochemical process of higher industrial relevance. It may be carried out by resorting to the three technologies of membrane electrolysis, diaphragm electrolysis and mercury cathode electrolysis.

The subsequent evolution of diaphragm plants has led to the introduction of polymer diaphragms made hydrophilic by means of various additives, for instance, zirconium oxide fibres or particles, instead of the traditional asbestos ones, overcoming the main inconvenience of this technology from an environmental standpoint. From the point of view of energy consumption, several improvements have been introduced which have slowed down the disposal of diaphragm cells in favour of the membrane technology, which initially appeared to be unavoidable. At first, the conventional expandable anodes of titanium activated with noble metal oxides were substantially improved by means of a so called zero-gap version, that is, provided with devices capable of exerting an elastic pressure and of bringing the movable surface of the anode into a direct and extended contact with the diaphragm. These anodes were later provided with double expanders, such term indicating the connections which allow the passage of electric current from the anode movable surfaces to the current collecting stems, with a sensible reduction of the relevant ohmic drop. Moreover, devices allowing to sensibly increase the brine internal recirculation may be advantageously installed on the anodes, with a consequent advantage in terms of lower voltage and lower oxygen release, both of which elements allow decreasing the energy consumption per ton of produced chlorine.

Finally, the replacement of the rubber linings with titanium sheets to protect the copper bases whereon the anodes are fixed and the adoption of new kinds of elastic gaskets between cathode body and anode support base and between each anode and the support base allowed to remarkably extend the operative life-time of the individual cells making up an electrolysis plant, from which followed a further decrease of the maintenance costs and a higher productive capacity for a given cell design.

A description of the functioning of chlorine-caustic soda diaphragm cells is provided in a very clear fashion in *Ullmann's Encyclopaedia of Chemical Technology,* 5a Ed., Vol. A6, pg. 424-437, VCH, while details of the internal structure of such cells are exhaustively illustrated in the drawings of the prior art. Only after several modifications made to the diaphragms and the anodes with the relevant way of fastening to the support base, the attention was recently focused on the cathodes, indicating with this term both the body with the relevant electrical connections and the structure of the cathode active area which is the site of the hydrogen release reaction and of the generation of caustic soda. In particular, as regards the cathode active area, this consists of a mesh of interwoven wires or of a perforated sheet both made of conductive material, generally carbon steel, shaped so as to form structures similar to prisms with a rather flattened rectangular section, secured by welding to a perimetrical chamber, also made of interwoven wires or perforated sheets, connected to the side-walls of the cathode body and provided with at least one nozzle in the lower part for the outlet of the solution containing the caustic soda product and the residual sodium chlorine, and with at least one nozzle in the upper part for the discharge of hydrogen. On these structures, known among those skilled in the art as fingers (a wording which will be therefore adopted in the following), the diaphragm is deposited by vacuum sucking of an aqueous suspension containing polymer fibres and particles which constitute the diaphragm itself, as mentioned above. In the diaphragm cell structure, the diaphragm-covered fingers are intercalated with the anodes, whose surface can be either in contact with that of the diaphragms or be spaced by a few millimetres. In both cases, it is necessary that the fingers do not undergo deflections which would cause abrasions on the diaphragm with consequent damaging thereof. Furthermore, during operation the current must be transmitted in the most uniform possible fashion to the whole finger surface. A non-uniform distribution would cause a cell voltage increase and a reduction of the caustic soda generation efficiency with a simultaneous higher oxygen content in the chlorine. It follows that for a better result, the fingers must be provided with adequate stiffness and at the same time with high electrical conductivity.

According to the prior art, the fingers are provided with a longitudinally corrugated carbon steel or copper internal plate. The mesh of interwoven wires or perforated sheet is secured, preferably by welding, to the apexes of the corrugations, solving the problem of homogeneous current distribution and of stiffening.

Nevertheless, the corrugations developed in a longitudinal direction do not allow the hydrogen bubbles to rise freely in the vertical direction, to gather along the finger upper generatrix and then to penetrate into the perimetrical chamber provided as mentioned with at least one gas discharge nozzle. The longitudinally corrugated plate forces hydrogen to gather under each of the corrugations and to flow longitudinally along each of the corrugations until discharging across suitable perforations to the perimetrical chamber. Since this flow can hardly be equalised, it follows that the amount of hydrogen present under each corrugation is variable and occludes the facing diaphragm fraction to a different extent. In a last analysis, it can be said that the longitudinally corrugated internal plate determines an inevitable unbalance in the electric current distribution. Such an unbalance, in its turn, leads to a differentiation of caustic concentration, with a negative outcome on the faradic production yield and on the oxygen content in the chlorine.

The prior art also discloses the use of corrugated internal plates, but with vertically arranged corrugations. In this case it is apparent that hydrogen can freely gather in the finger upper part. However, its flow toward the perimetrical chamber is hindered by the upper part of the corrugations. Moreover, for a given electric current distribution, the stiffening effect of the vertical corrugations may be unsatisfactory.

There has also been disclosed designs for the finger internal element in which perforated horizontal plate strips or longitudinal conductive stems are provided with vertical plate strips welded thereto. While certainly assuring an adequate stiffness, the latter solution is affected by the problem of difficult hydrogen discharge previously discussed.

While some prior art designs represent a satisfactory answer to the requirements of stiffness, current distribution homogeneity and free hydrogen discharge, they have done so at the cost of a complex structure, difficult to produce and hence excessively expensive. Furthermore, the structures do not allow the hydrogen bubble upward motion to establish an adequate recirculation of the caustic soda product inside the fingers. As a consequence of this lack of recirculation, pockets of caustic soda of higher concentration may be formed, particularly in the case of anomalies in the electric current distribution and in the porosity of the diaphragms, with negative consequences as regards the electrolysis faradic efficiency and the oxygen content in the chlorine.

A more advanced solution, overcoming to a great extent the above illustrated drawbacks of the cathode finger internal plates, has been proposed in which the plate inside the cathode fingers is provided with bumps, for instance spherical caps, arranged quincuncially, or in accordance with other patterns which facilitate the free circulation of the electrolyte while providing for an electrical connection of well distributed ohmic paths.

There has been described the use of this plate for fingers obtained both out of meshes of interwoven wires, and out of perforated sheets. As a matter of fact, if in the latter case the proposed solution appears to be entirely optimal, in the former case the coupling between mesh and bump plate is in many cases unsatisfactory. Not every wire of the mesh can in fact intercept the various protrusions correctly, and statistically many of them cannot transport the current in an effective way, since the relevant ohmic path results excessively long.

It is thus identified the specific need to find an improved design of internal reinforcing and current-distributing structure for diaphragm cell cathode fingers consisting of conductive meshes, for example interwoven wire meshes.

SUMMARY OF THE INVENTION

In one embodiment, the invention is directed to a cathode finger for diaphragm electrolysis cell, provided with an internal volume and comprising at least one external conductive mesh covered with a chemically inert porous diaphragm, and an internal reinforcing and current-distributing structure consisting of at least one plate provided with a series of elongated main protrusions whose short side is opened to the passage of fluids and whose surface is provided with a series of secondary protrusions directly welded to said conductive mesh.

In another embodiment, the invention is directed to an electrolysis cell comprising an anodic compartment and a cathodic compartment separated by an inert porous diaphragm, said cathodic compartment consisting of a cathode body, a perimetrical chamber provided with at least one nozzle for the discharge of electrolytes in the lower part and at least one nozzle for the discharge of gas in the upper part, and of a multiplicity of cathode fingers of any one of the previous claims electrically connected to said cathode body.

In a further embodiment, the invention is directed to a chlor-alkali electrolytic process comprising feeding a sodium chloride solution to the anodic compartment of a cell comprising an anodic compartment and a cathodic compartment separated by an inert porous diaphragm, said cathodic compartment consisting of a cathode body, a perimetrical chamber provided with at least one nozzle for the discharge of electrolytes in the lower part and at least one nozzle for the discharge of gas in the upper part, and of a multiplicity of cathode fingers of any one of the previous claims electrically connected to said cathode body; applying an electric current to the cell; and discharging a solution of caustic soda and residual sodium chloride generated in said internal volume of said multiplicity of cathode fingers through said nozzle for the discharge of electrolytes and a hydrogen stream through said nozzle for the discharge of gas.

BRIEF DESCRIPTION OF THE FIGURES

The invention will be described hereafter with the support of the following figures.

DETAILED DESCRIPTION

Under one aspect, the invention comprises a cathode finger for diaphragm electrolysis cells delimited by an external conductive mesh covered with a chemically inert porous diaphragm acting as a separator and whose internal volume, wherein the production of caustic soda takes place, is divided by at least one plate provided with a series of elongated main protrusions whose shorter side is opened to the passage of fluids and whose surface is provided with a series of secondary protrusions directly welded to said conductive mesh.

Figure 1:
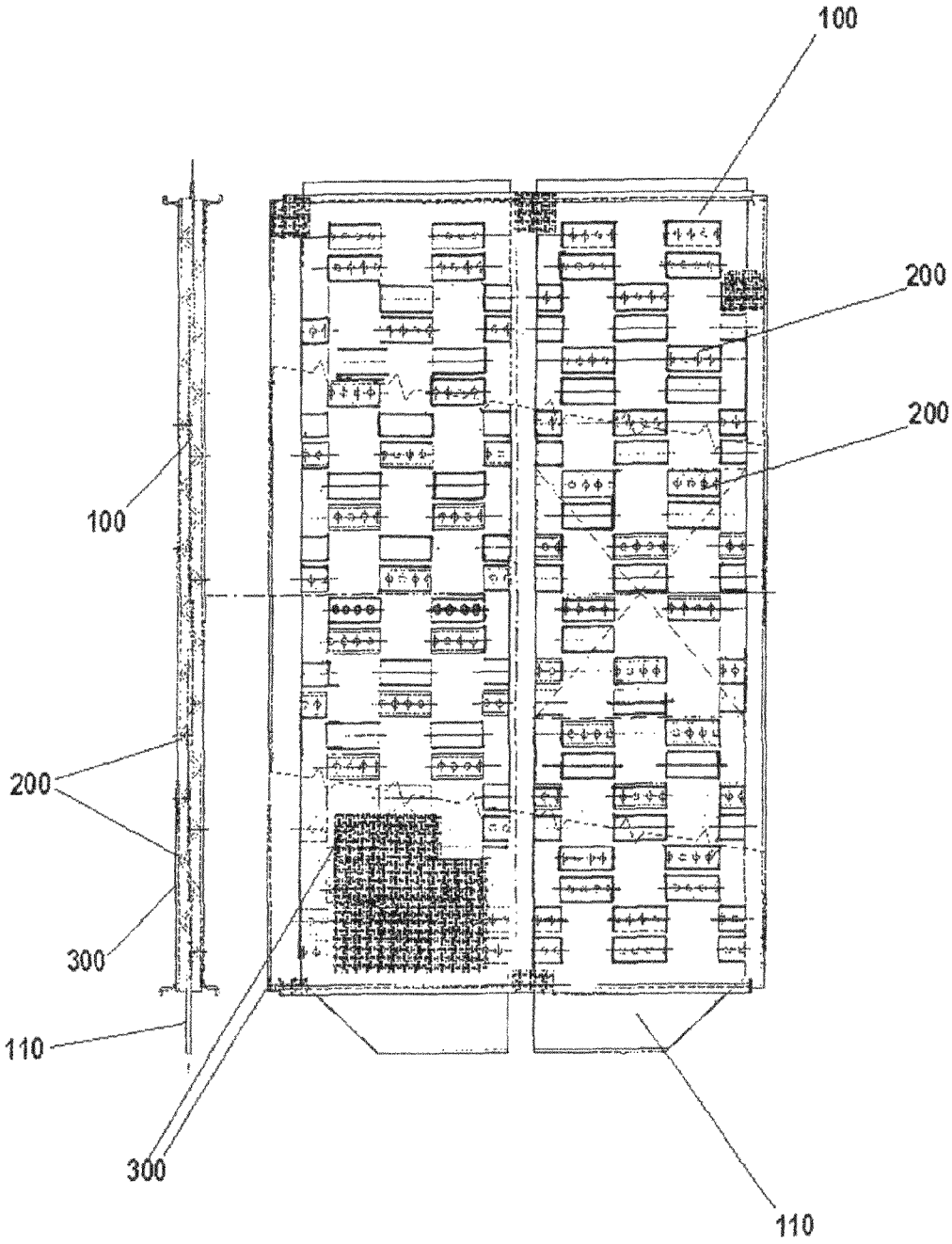
FIG. 1 illustrates a cutaway and a corresponding side-view of a cathode finger for diaphragm electrolysis cells with an internal reinforcing structure provided with protrusions according to an embodiment of the invention.

As illustrated in FIG. 1, there is shown a cutaway and a corresponding side-view of a cathode finger, in which the central element consists of two conductive reinforcing plates (100), each provided with a series of elongated protrusions (200) whereto are fixed two external conductive meshes (300) covered with a porous diaphragm (not shown). In the particular case of the figure, the main protrusions (200) are advantageously arranged in offset rows, and the extremities (110) of the conductive mesh (100) partially extend beyond the region of the meshes (300) welded thereto.

Figure 2:
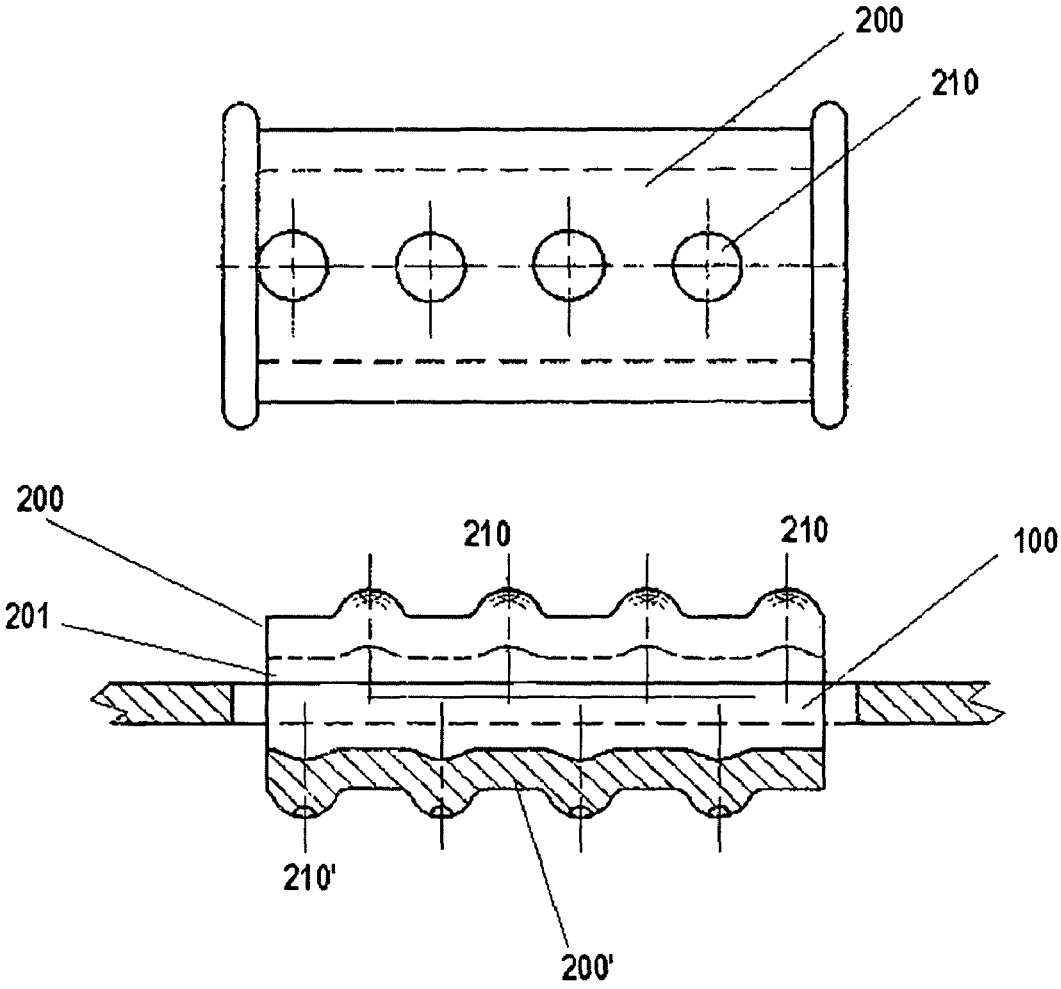
FIG. 2 illustrates the top-view and the longitudinal section of one protrusion of the internal reinforcing structure according to an embodiment of the invention.

In FIG. 2, there is illustrated one embodiment of the elongated main protrusions (200) according to the invention. In the upper part of the drawing, there is shown the top-view of a main protrusion (200) provided in its turn with a series of secondary protrusions (210) shaped as spherical caps. In the lower part, there is shown a corresponding longitudinal section of the same piece, in which the offset position of one main protrusion (200) with the relevant secondary protrusions (210) with respect to the adjacent one (200') with the relevant secondary protrusions (210') is evidenced. It is also evidenced how the short side (201) of the main protrusion (200) is opened to the free passage of fluids, in order to allow a more effective recirculation.

In one embodiment, the elongated main protrusions comprise 3 to 6 secondary protrusions, which may have a shape similar to a spherical cap. In one embodiment, the elongated main protrusions are arranged along reciprocally offset parallel rows, so as to intercept the various wires constituting the external mesh in a more effective manner. For example, in meshes consisting of interwoven structures of warp and weft wires, the warp wires are welded to the secondary protrusions, and a suitably dimensioned offset structure is the most appropriate to intercept said wires in a useful fashion, minimising the electric current path along the same. According to one embodiment, the cathode mesh whereto the diaphragm is secured is shaped as a box with open extremities, beyond which the reinforcing structure of the invention partially extends; such portion extending beyond the two mesh extremities may be advantageously welded or otherwise fastened to the cathodic perimetrical chamber, in order to efficiently perform the role of electric current distributor.

Figure 3:
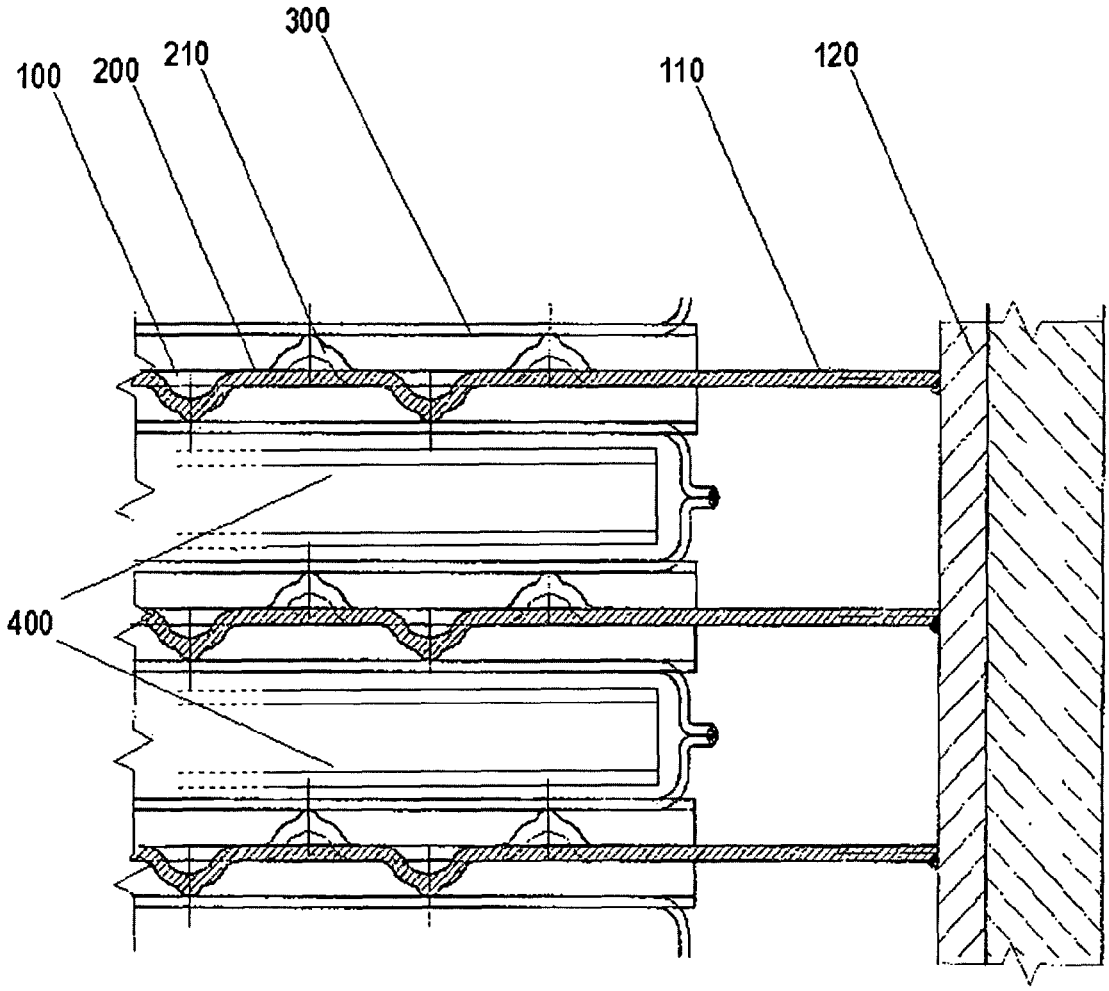
FIG. 3 illustrates a connection of cathode fingers to the cell cathode body according to an embodiment of the invention.

FIG. 3 shows how the extremities (110) of the reinforcing conductive plates (100) of the various cathode fingers are connected, in one embodiment of the invention, to the cell cathode body (120). The same figure shows how the different cathode fingers are intercalated to a series of anodes (400) as known in the art.

In one embodiment, the invention is directed to a diaphragm electrolysis cell comprising two compartments, anodic and cathodic, wherein the cathodic compartment consists of a perimetrical chamber provided with an electrolyte outlet nozzle in the lower part and a gas outlet nozzle in the upper part, and with a multiplicity of cathode fingers in accordance with the invention.

In another embodiment, the invention is directed to an alkali chloride electrolysis process, for instance chlorine-caustic soda electrolysis, carried out by feeding a salt solution, for instance sodium chloride brine to the anodic compartment of a diaphragm electrolysis cell comprising the cathode finger of the invention, and by applying direct electric current thereby discharging a caustic solution, for instance caustic soda containing residual sodium chloride from the internal volume of each cathode finger, and a hydrogen stream from the cathodic outlet nozzle, while at the anode the simultaneous evolution of chlorine takes place.

The following example is included to demonstrate particular embodiments of the invention. It should be appreciated by those of skill in the art that the techniques disclosed in the examples which follow represent techniques discovered by the inventors to function well in the practice of the invention. However, those of skill in the art should, in light of the present disclosure, appreciate that many changes can be made in the specific embodiments which are disclosed and still obtain a like or similar result without departing from the spirit and scope of the invention.

EXAMPLE

To allow a comparative evaluation of the validity of the finding of the present invention, two industrial-size diaphragm chlor-alkali cells were assembled, to be fed with a current density of 100 kA. The above referenced cells were provided with a cathode body comprising fingers consisting of a mesh of carbon steel interwoven wires whereon a polymer porous diaphragm added with zirconium oxide particles was deposited, as known in the art. One cell was internally equipped with bump plates in accordance with WO 2004/007803, while the other was equipped with reinforcing conductive plates in accordance with the invention, having rectangular main protrusions each provided with four spherical cap-shaped secondary protrusions whereto the meshes were directly welded, as shown in the figures. Both plates had a thickness of 6 mm.

After a few weeks of operation, considered to be necessary for the stabilisation of the various components and in particular of the diaphragms, the cell voltages, faradic yield of the caustic soda production and oxygen content in the product chlorine were recorded, with the following results:

- cell in accordance with the prior art: voltage 3.5 volt, faradic efficiency 95%, oxygen content in chlorine 2.3%
- cell in accordance with the invention: voltage 3.35 volt, faradic efficiency 96%, oxygen content in chlorine 2.3%.

Although the disclosure has been shown and described with respect to one or more embodiments and/or implementations, equivalent alterations and/or modifications will occur to others skilled in the art based upon a reading and understanding of this specification. The disclosure is intended to include all such modifications and alterations and is limited only by the scope of the following claims. In addition, while a particular feature may have been disclosed with respect to only one of several embodiments and/or implementations, such feature may be combined with one or more other features of the other embodiments and/or implementations as may be desired and/or advantageous for any given or particular application. Furthermore, to the extent that the terms "includes", "having", "has", "with", or variants thereof are used in either the detailed description or the claims, such terms are intended to be inclusive in a manner similar to the term "comprising."

I claim:

1. A cathode finger for diaphragm electrolysis cell, provided with an internal volume and comprising at least one external conductive mesh covered with a chemically inert porous diaphragm, and an internal reinforcing and current-distributing structure consisting of at least one plate provided with a series of elongated main protrusions having a short side opened to the passage of fluids and whose surface is provided with a series of secondary protrusions directly welded to said conductive mesh.

2. The cathode finger of claim 1 wherein each of said elongated main protrusions comprises 3 to 6 of said secondary protrusions.

3. The cathode finger of claim 1 wherein said secondary protrusions have a shape similar to a spherical cap.

4. The cathode finger of claim 1 wherein said elongated main protrusions are arranged in offset rows.

5. The cathode finger of claim 1 wherein said mesh consists of an interwoven structure of warp and weft wires, and said warp wires are welded to said secondary protrusions.

6. The cathode finger of claim 5 wherein said mesh is shaped as a box with open extremities beyond which a portion of said internal reinforcing structure extends.

7. The cathode finger of claim 6 wherein said portion of said internal reinforcing structure extending beyond said box-shaped mesh is fastened to the cathode body of the diaphragm electrolysis cell, optionally by welding.

8. An electrolysis cell comprising an anodic compartment and a cathodic compartment separated by an inert porous diaphragm, said cathodic compartment consisting of a cathode body, a perimetrical chamber provided with at least one nozzle for the discharge of electrolytes in the lower part and at least one nozzle for the discharge of gas in the upper part, and of a multiplicity of cathode fingers provided with an internal volume and comprising at least one external conductive mesh covered with a chemically inert porous diaphragm, and an internal reinforcing and current-distributing structure consisting of at least one plate provided with a series of elongated main protrusions having a short side opened to the passage of fluids and whose surface is provided with a series of secondary protrusions directly welded to said conductive mesh, electrically connected to said cathode body.

9. A chlor-alkali electrolytic process comprising:

feeding a sodium chloride solution to the anodic compartment of a cell comprising an anodic compartment and a cathodic compartment separated by an inert porous diaphragm, said cathodic compartment consisting of a cathode body, a perimetrical chamber provided with at least one nozzle for the discharge of electrolytes in the lower part and at least one nozzle for the discharge of gas in the upper part, and of a multiplicity of cathode fingers of any one of the previous claims electrically connected to said cathode body, applying an electric current to the cell; and discharging a solution of caustic soda and residual sodium chloride generated in said internal volume of said multiplicity of cathode fingers through said nozzle for the discharge of electrolytes and a hydrogen stream through said nozzle for the discharge of gas.

* * * * *